US005447606A

United States Patent [19]

Pruitt

[11] Patent Number: 5,447,606

[45] Date of Patent: Sep. 5, 1995

[54] METHOD OF AND APPARATUS FOR CAPTURING COKE OVEN CHARGING EMISSIONS

[75] Inventor: Charles W. Pruitt, Pounding Mill, Va.

[73] Assignee: Sun Coal Company, Knoxville, Tenn.

[21] Appl. No.: 59,673

[22] Filed: May 12, 1993 (Under 37 CFR 1.47)

[51] Int. Cl.[6] ..... C10B 27/04

[52] U.S. Cl. ..... 201/40; 201/41; 202/263

[58] Field of Search ..... 201/40, 41; 202/263

[56] References Cited

U.S. PATENT DOCUMENTS

| | | | |
|---|---|---|---|
| 3,676,305 | 7/1972 | Cremer | 202/263 |
| 3,709,794 | 1/1973 | Kinzler et al. | 202/263 |
| 3,746,626 | 7/1973 | Morrison, Jr. | 202/263 |
| 3,784,034 | 1/1974 | Thompson | 214/21 |
| 3,839,161 | 10/1974 | Pries | 202/263 |
| 3,857,758 | 12/1974 | Mole | 201/40 |
| 3,957,591 | 5/1976 | Riecker | 202/263 |
| 4,004,702 | 1/1977 | Szendroi | 214/35 |
| 4,100,033 | 7/1978 | Holter | 202/263 |
| 4,287,024 | 9/1981 | Thompson | 202/134 |
| 4,334,963 | 6/1982 | Stog | 202/263 |
| 4,395,269 | 7/1983 | Schuler | 55/302 |
| 5,114,542 | 5/1992 | Childress et al. | 201/15 |

*Primary Examiner*—Joye L. Woodard

*Attorney, Agent, or Firm*—Kerkam, Stowell, Kondracki & Clarke; James L. Bean

[57] ABSTRACT

Individual coke ovens in a nonrecovery coke oven battery are charged through an open door at the pushing end of the ovens, and emissions escaping through the open door of the respective ovens during charging are captured by a hood mounted on the pushing and charging machine for movement therewith along the pushing side of the battery and for movement thereon from a retracted position spaced outwardly from the ovens and a capturing position above the open oven door. Air and emissions captured by the hood are withdrawn and passed through an air cleaner mounted on the pushing and charging machine to remove smoke and particulates before being discharged to the atmosphere.

17 Claims, 6 Drawing Sheets

METHOD OF AND APPARATUS FOR CAPTURING COKE OVEN CHARGING EMISSIONS

BACKGROUND OF THE INVENTION

1. Field of the Invention

This invention relates to the control of coke oven charging emissions and more particularly to an improved method of and apparatus for capturing and cleaning the charging emissions from a coke oven of the type which is charged through the door opening at the pushing side of the oven battery.

2. Description of the Prior Art

The production of metallurgical coke in commercial coking operations has traditionally produced substantial atmospheric pollution. Recent concerns over the environment have resulted in ever stricter controls established by environmental regulating agencies on the amount of particulate and gaseous emissions of various types which may be admitted to the atmosphere by such coking operations. Continuous efforts to meet these requirements have resulted in a renewed interest in the nonrecovery coking process which has shown substantial improvements both in gaseous and particulate emissions over known byproduct or nonrecovery processes.

Nonrecovery coking batteries now in commercial use, illustrated for example in U.S. Pat. Nos. 5,114,542 and 4,287,024 and commonly referred to as Thompson ovens, employ sole flue heated ovens which are charged through an open door at one end of the elongated coking chamber by a charging conveyor mounted on a pushing and charging machine for projection into the oven through the open door. One source of objectionable pollution from coke ovens generally has been the charging emissions produced during charging the ovens with a fresh charge of coal to be coked. As coal is deposited into the hot oven, a surge of charging emissions in the form of gas containing steam, distillation products and a high percentage of unburned and partially burned particulate matter, is produced. The problem of controlling charging emissions in byproduct coking ovens is discussed in U.S. Pat. Nos. 4,004,702 and 3,857,758 and U.S. Pat. No. 4,287,024 discloses one attempt to control charging emissions in a Thompson oven by providing a closable bypass conduit extending between the top of the coking chamber and the waste heat tunnel.

While the emissions control system of the 4,287,024 patent effectively reduces charging emissions escaping to the atmosphere, some emissions invariably escaped through the open door of the oven. Further, it was found that in operation, the valve structure employed to open and close the gas flow bypass required substantial maintenance and when not operating properly, could result in increased stack emissions during the coking process. It is, therefore, a primary object of the present invention to provide an improved method of and apparatus for capturing and cleaning charging emissions escaping from the open door of a coke oven while the oven is being charged through the open door.

It is another object of the invention to provide a method of and apparatus for capturing charging emissions with a portable hood mounted on the charging and pushing machine for movement into position above the open door prior to commencing the charging operation and withdrawing air and emissions from the hood through a solids-separation device for removing solids from the charging emissions.

Another object of the invention is to provide a method of and apparatus for capturing particulate and gaseous charging emissions escaping from the open door of a nonrecovery sole flue coking oven during the charging operation and passing the captured emissions through a filter device for removing the particulate matter before discharging the filtered gases to the atmosphere.

SUMMARY OF THE INVENTION

In the attainment of the foregoing and other objects and advantages, an important feature of the invention resides in providing a self-contained pushing emission capturing apparatus supported on the oven charging machine for movement therewith along the battery. The emission capturing apparatus includes a hood supported above the door handling apparatus and the charging conveyor whereby, when the pushing and charging machine is maneuvered into position for charging an oven, the capture hood is positioned in front of and above the oven door.

A high volume exhaust blower has its intake connected to an emissions gas filtering apparatus for applying a suction through the filtering apparatus and a duct system to the emission capturing hood. When an oven door is opened in preparation for charging the oven, the battery draft system will continue to draw hot air from the oven, but some hot air and gas will escape through the open door. As the charging conveyor is projected through the open door beneath the hood to discharge coal into the hot oven, the surge of charging gases produced is too great for the normal battery draft system to handle and a portion of the charging emissions will escape through the open door and rise into the capturing emissions hood. Preferably the hood is mounted for movement toward and away from the oven battery, and the hood may include movable wall means for forming a seal with the oven being charged at a location above the open door.

The captured emissions are mixed with ambient air in the hood and withdrawn through the duct system and filtering apparatus by the exhaust blower where the particular emissions are removed by the filtering apparatus and the filtered air and gas are discharged to the atmosphere. Upon completion of the oven charging operation, the oven door is replaced and the emission capturing hood and the pushing and charging machine can be advanced along the front of the battery to the next oven to be charged.

The filtering apparatus includes a plurality of hoppers for containing the filtered particulate matter. These hoppers may be opened periodically, as when all the ovens in a battery have been pushed and charged, to permit the solids which have been filtered from the emission gases to fall, by gravity, from the system.

BRIEF DESCRIPTION OF THE DRAWINGS

The foregoing and other features and advantages of the present invention will be apparent from the following detailed description, taken in conjunction with the drawings, in which.

DESCRIPTION OF THE PREFERRED EMBODIMENT

Figure 1:
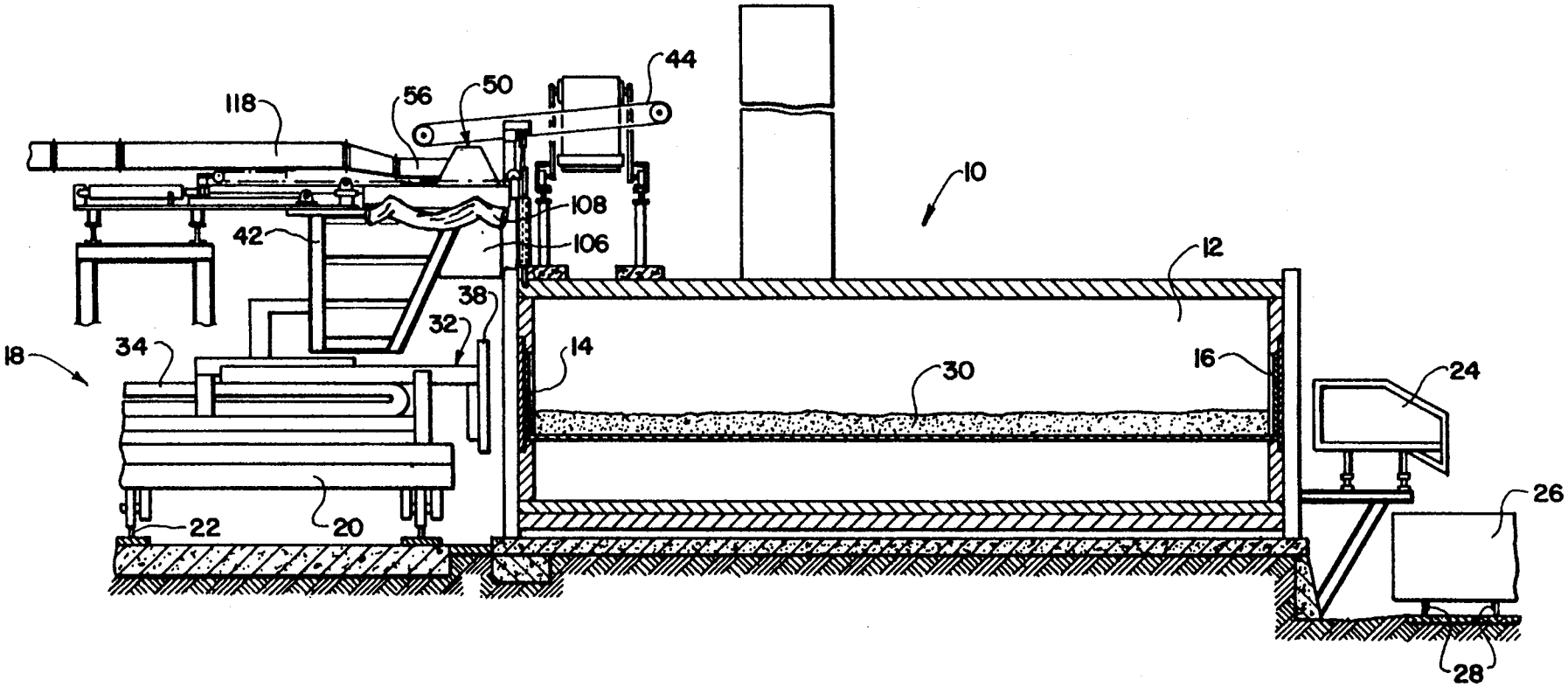
FIG. 1 is a fragmentary longitudinal sectional view of a front charging nonrecovery coke oven and an oven charging and pushing machine including a portion of the charging emission capturing device of the present invention.

Referring now to the drawings in detail, a front charging nonrecovery coke oven is shown in longitudinal section in FIG. 1 and designated generally by the reference numeral 10. Oven 10 has an elongated coking chamber 12 having its opposed open ends normally closed by doors 14, 16. A plurality of ovens 10 are normally constructed in side-by-side relation in a battery as shown in the above-mentioned U.S. Pat. No. 4,287,024 and the individual ovens are charged with coal by a combined pushing and charging machine 18 supported on a wheeled car 20 for movement along tracks 22 at the front or charging side of the battery of ovens. Coke is pushed from the oven through a coke guide 24 into a coke car 26 movable along tracks 28 at the back or coke side of the battery.

Figure 2:
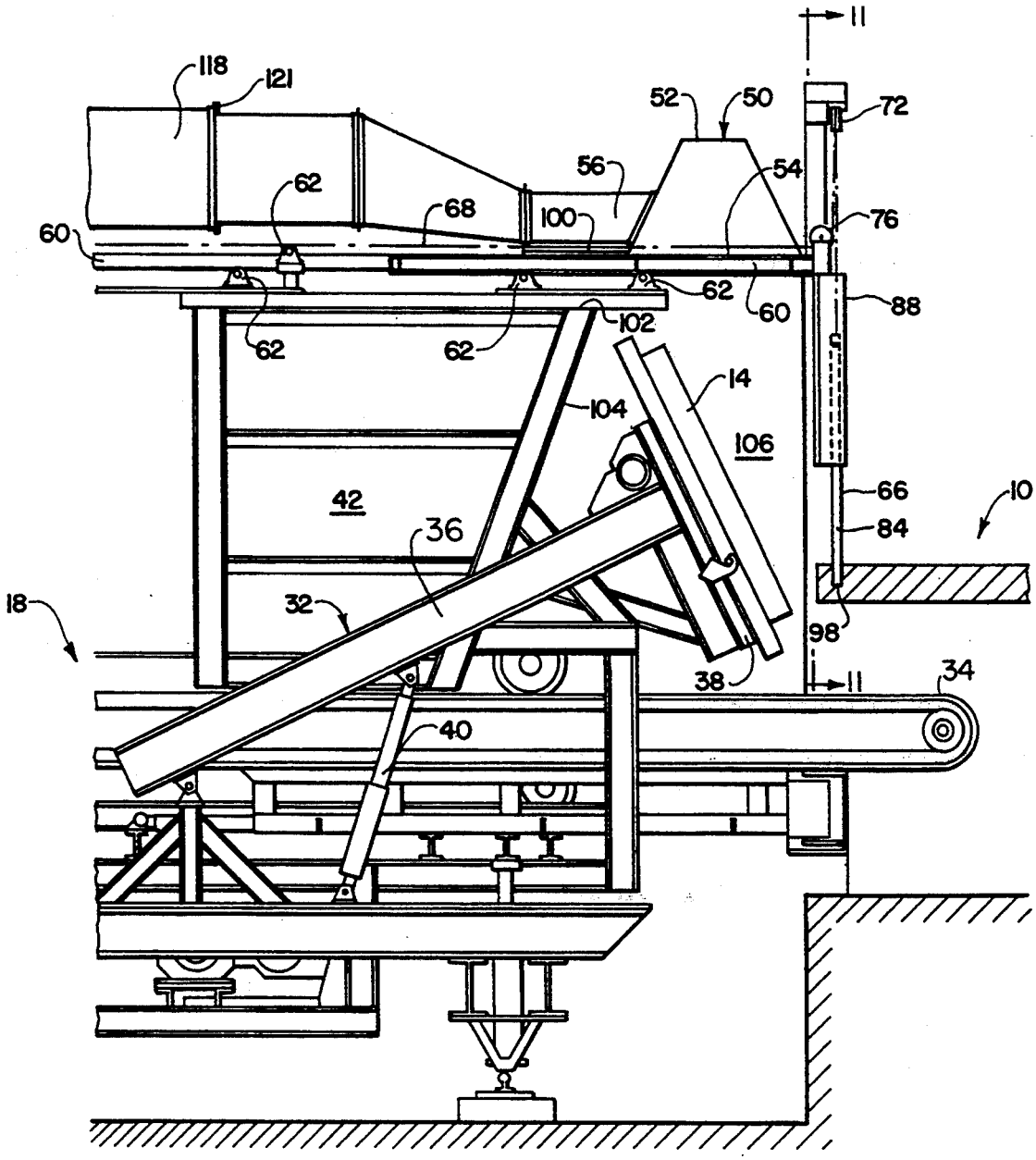
FIG. 2 is an enlarged view of a portion of the structure shown in FIG. 1 and illustrating an oven being charged with coal.

A detailed description of the construction and operation of front charging nonrecovery Thompson coke ovens may be had by reference to the above-mentioned U.S. Pat. No. 5,114,542, the entire disclosure of which is incorporated herein by reference and a detailed description of a pushing and charging machine used with such ovens may be had by reference to U.S. Pat. No. 3,784,034, the entire disclosure of which is also incorporated herein by reference. Briefly, however, when a coal charge 30 has been coked, doors 14 and 16 will be removed and the hot coke will be pushed through door 16 and coke guide 24 into coke car 26 by a ram carried on pushing charging machine 18 and projected through the chamber 12. Thereafter, doors 14 and 16 will be replaced and the machine 18 advanced to position the charging conveyor in front of the empty oven. Door 14 is again removed by a door handler machine 32 and a new charge of coal will be deposited into the empty chamber 12 by a drag-type conveyor 34 which is projected through the open door 14 to progressively charge the oven with coal to the desired depth throughout the length of the oven. During this charging process, the door 14 is supported above and slightly outward from the open end of the coking chamber as seen in FIG. 2.

Prior to charging, the interior refractory material of the coke chamber will normally be at a temperature in excess of 2,000° F. Accordingly, as green coal is deposited in the open chamber, violent burning commences and a surge of charging emissions is produced. These charging emissions are a mixture of air, water vapor, burned and partially burned distillation products from the coal, and solids, smoke and other matter entrained in the surge of gas from the burning coal. Although a draft is continuously maintained to the oven chamber from the stack through the oven flue system as described in U.S. Pat. No. 5,114,542, a portion of the intensely hot charging emissions invariably escapes through the open end of the oven above the charging conveyor.

The door handler 32 includes a frame 36 supported for pivotal movement about a horizontal axis parallel to the tracks 22 and for limited horizontal movement toward and away from the ovens. A door clamping and supporting head 38 is mounted on frame 36 in position to releasably engage lifting bars, not shown, on doors 14. When an oven is to be charged, the door handler is projected forward to engage and firmly clamp the door, then retracted to withdraw the door clear of the oven. Fluid cylinder 40 is then actuated to pivot frame 36 upwardly a distance sufficient to permit the drag-type conveyor 34 to be projected into the open door beneath the bottom edge of the door 14 to charge the oven.

During charging, coal is deposited on the conveyor 34 from a hopper 42 mounted above the conveyor on the charging machine for movement therewith, and coal may be supplied to the hopper 42 by suitable means such as a belt conveyor and diverter 44, positioned above the oven battery. Coal from the hopper 42 is conveyed into the oven chamber 12 to fill the oven to the height of conveyor 34 progressively from the open door 14 to the closed door 16 as conveyor 34 is driven and projected into the conveyor in the manner described in U.S. Pat. No. 3,784,034. Conveyor 34 is then retracted and the door handler 32 is actuated to replace door 14 to seal the oven chamber until the new charge is coked and the pushing and charging cycle is repeated.

Figure 3:
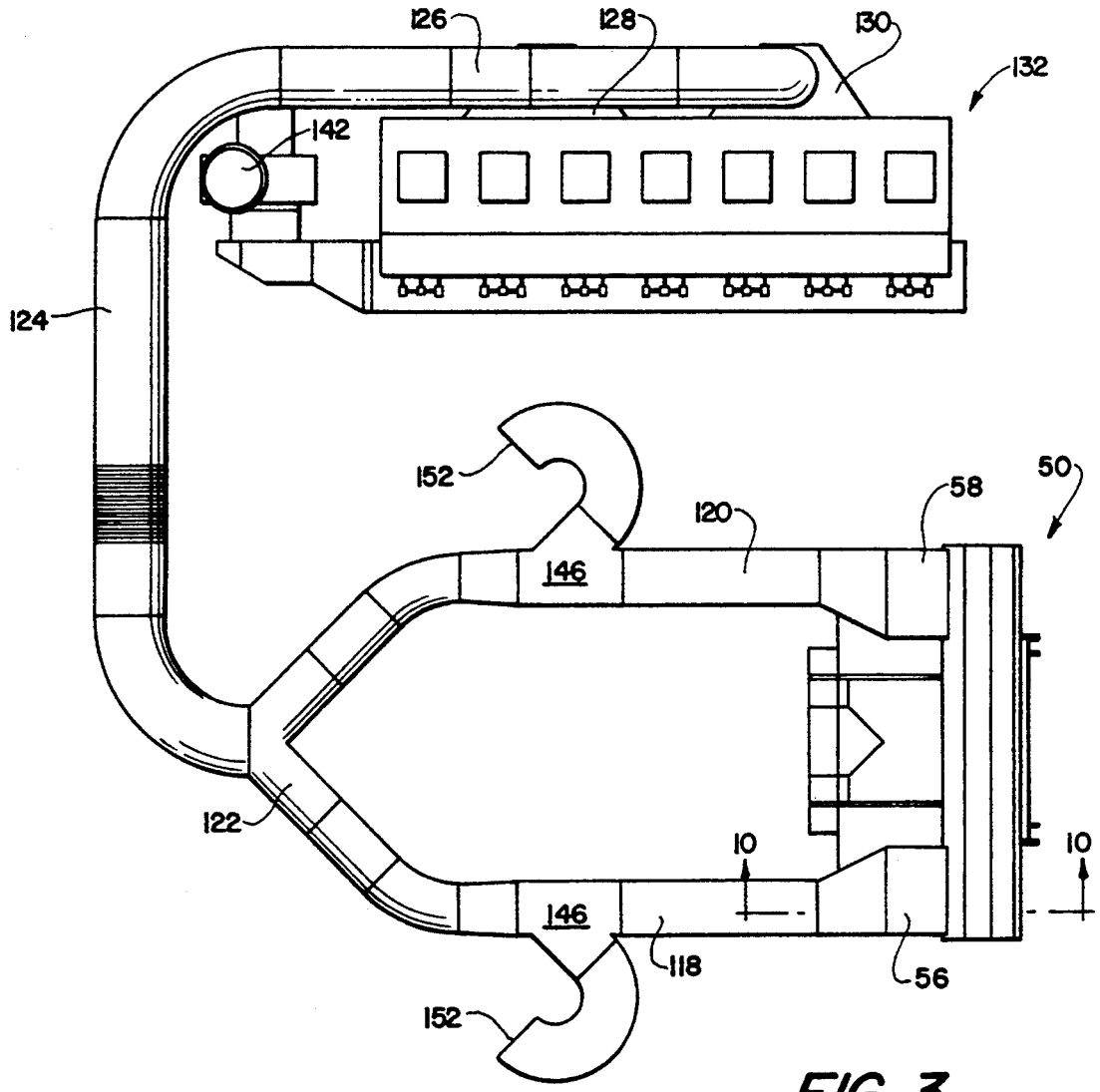
FIG. 3 is a top plan view of the charging emission capturing apparatus of the present invention.
Figure 4:
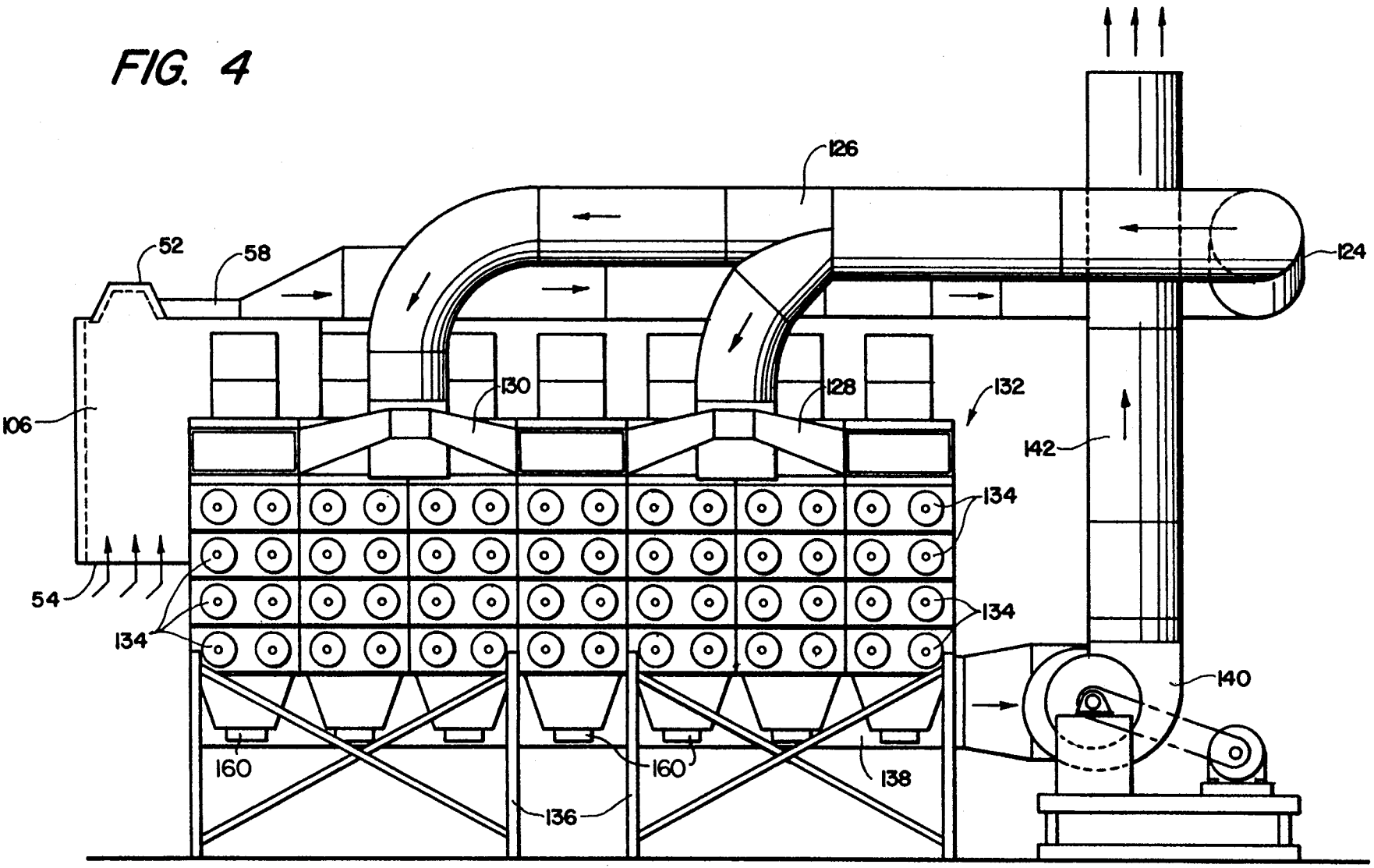
FIG. 4 is an end elevation view of the emission capturing apparatus shown in FIG. 3.

Charging emissions escaping through the open door are captured and cleaned in accordance with the present invention before the emissions can pollute the atmosphere. As best seen in FIGS. 3 and 4, the emission capturing apparatus comprises an elongated hood 50 having a closed top 52 and an open bottom 54, with the hood having a pair of rearwardly projecting outlet duct sections 56, 58 located one adjacent each end near the top 52.

Figure 5:
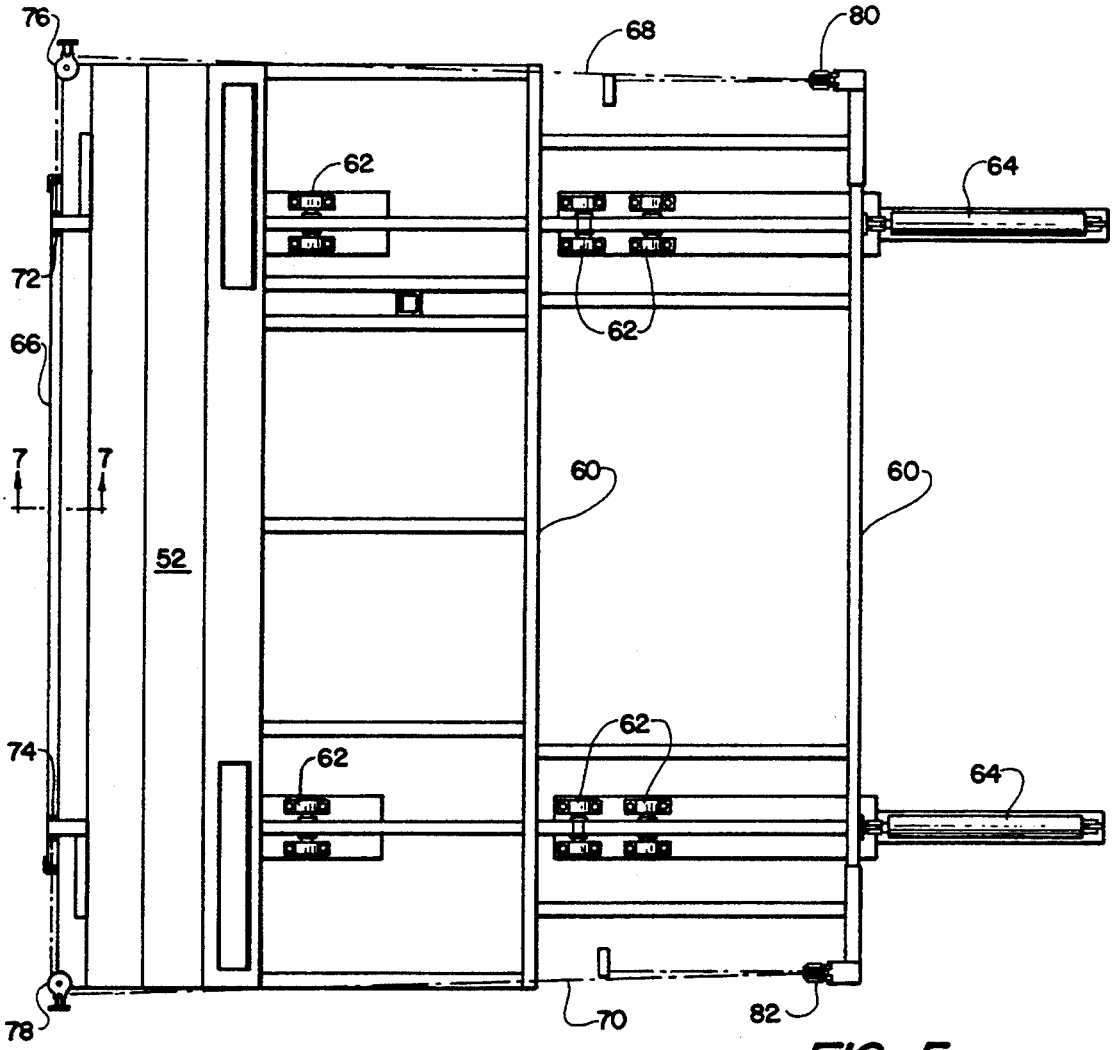
FIG. 5 is an enlarged top plan view of the emission capturing hood support and actuating structure.
Figure 6:
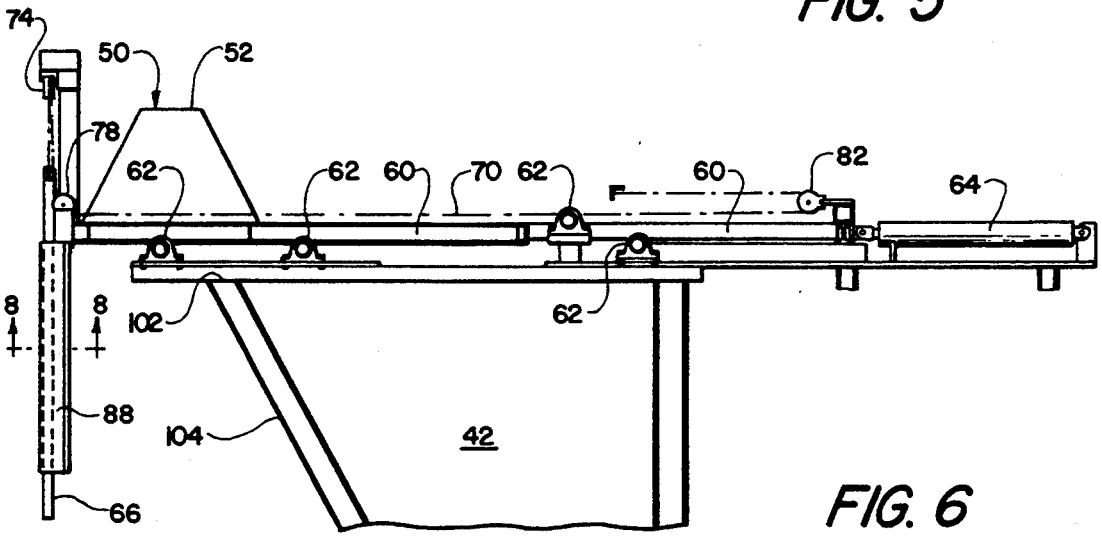
FIG. 6 is a side elevation view of the structure shown in FIG. 5.
Figure 7:
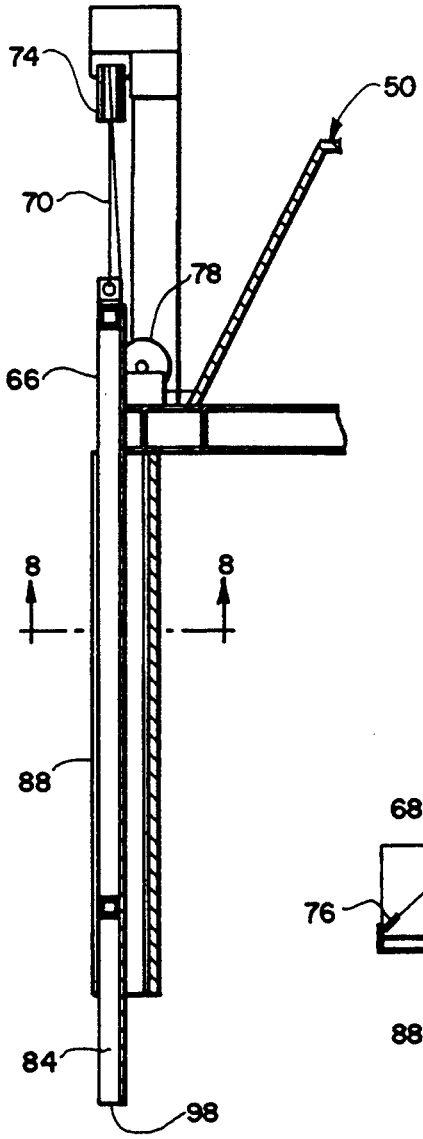
FIG. 7 is a fragmentary side elevation showing the support structure for the front wall of the emission capturing hood.
Figure 8:
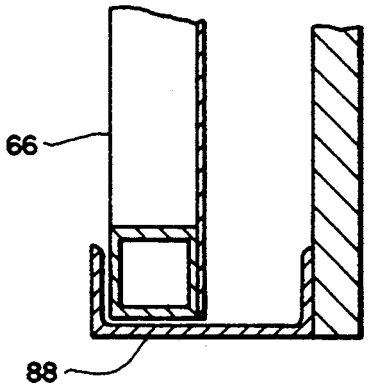
FIG. 8 is an enlarged sectional view taken on line 8—8 of FIG. 7.

Hood 50 and the outlet duct sections 56, 58 are mounted on a rigid, generally rectangular horizontal frame 60 which, in turn, is mounted on car 20 above conveyor 34 for limited horizontal movement toward and away from the coke ovens as best seen in FIGS. 5 and 6. Frame 60 is supported by a plurality of roller blocks 62, and a pair of fluid cylinders 64 connected between frame 60 and the rigid structural frame of car 20 are operable to move the frame and the hood supported thereon between an extended, operable position and a retracted position.

Hood 50 has a front wall 66 supported for movement in a vertical direction by a pair of cables 68, 70 each having one end connected to the top portion of the wall 66 one adjacent each vertical edge thereof. Cables 68, 70, respectively extend upwardly and over pulleys 72, 74, respectively, then downward and around pulleys 76, 78, respectively. From pulleys 76, 78, cables 68, 70 extend rearwardly (away from the ovens 10) around pulleys 80, 82, respectively, mounted on frame 60, then forwardly (toward ovens 10) to have their ends connected to a rigid structural member of car 20. The vertical side edges 84, 86 of wall member 66 are disposed in generally vertical extending guide channels 88, 90, respectively. Channels 88, 90 preferably have a transverse dimension greater than the thickness of the edges of wall 66 to permit limited movement of the bottom portion of wall 66 toward and away from the pushing and charging machine 18.

When fluid cylinders 64 are actuated to move frame 60 and hood 50 toward the ovens, cables 68, 70 will permit wall 66 to move downwardly by gravity a distance substantially twice the distance the frame and hood are moved. Conversely, when the hood is moved away from the ovens, wall 66 may be lifted a distance substantially twice the distance the hood is moved.

Figure 11:
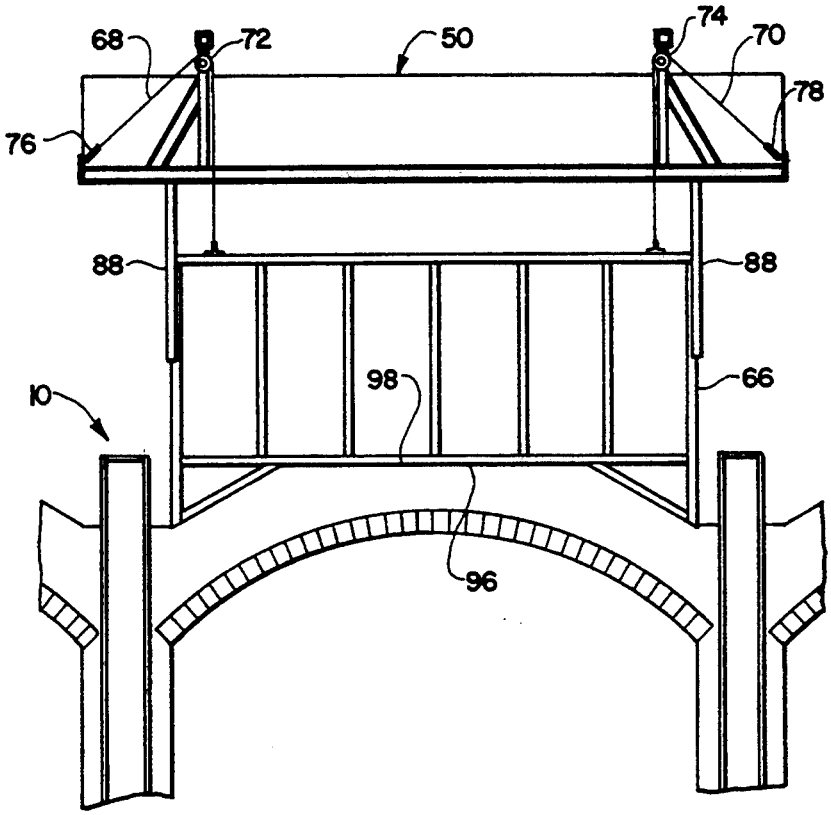
FIG. 11 is a fragmentary sectional view taken on line 11—11 of FIG. 2.

The individual coke ovens 10 preferably have a contoured ledge 96 (FIG. 11) on the top wall thereof adjacent the front of the oven, and ledge 96 is engaged by a complementary contoured bottom edge 98 on movable wall 66 to provide a generally gas tight connection whereby, when the hood 50 is projected to the operative position, emissions arising from the open oven are captured in the hood.

Figure 10:
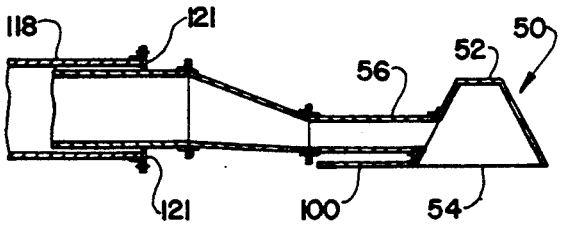
FIG. 10 is a fragmentary sectional view taken on line 10—10 of FIG. 3.

As best seen in FIGS. 2 and 10, hood 50 also has a generally horizontal rearwardly extending wall member 100 overlaying the forward edge 102 of hopper 42. The forwardly and upwardly inclined wall 104 of the hopper cooperates with wall 100 to form a generally gas tight rear wall for the hood enclosure. Wall 100 is dimensioned to overlay the edge 102 throughout the full extent of movement of hood 50. The conveyor diverter 46 extends over hopper 42 a distance to permit coal to be discharged into the hopper over the wall member 100.

Hood 50 also includes a rigid, fixed end wall 106 which extends rearwardly along one end of hopper 42 and downwardly to a location adjacent the lateral edge of conveyor 34 to effectively close the hood at one end thereof. The Opposite end of the hood is preferably closed by a movable wall which may be opened or retracted to permit viewing of the end of the oven as to permit an operator to accurately position the charging machine in front of the oven to be charged. The fixed and movable end walls of the hood cooperate with the hopper wall 104 and the conveyor 34 to effectively seal the hood from the atmosphere during the charging operation.

In FIG. 1, the movable end wall is illustrated as a heavy, flexible heat resistant curtain 108 which may either be rolled up as shown or retracted along a horizontal track (not shown) in order to permit viewing into the interior of the hood. It is believed apparent that the curtain 108 could also be replaced by a movable rigid metal panel or the like. In operation, it has been found that the emission capturing operation of this invention is effective in withdrawing emissions from the hood even with the curtain 108 open or only partially closed under most operating conditions, and need only be completely closed under severe wind conditions. When the curtain 108 is closed, and when the conveyor 34 is projected into the oven, the hood is effectively closed to the atmosphere so that suction applied to the hood effectively contains all emissions escaping from the open oven door.

The outlet ducts 56, 58 are mounted on hood 50 for movement therewith, one adjacent each end of the hood at a location above the top of the hopper 42. As seen in FIG. 10, duct section 56 is in fluid communication with the interior of hood 50 and extend rearwardly therefrom to terminate in an open end telescopingly received in the open end of elongated duct 118 rigidly mounted on the rigid structure of the charging machine 18. Duct section 58 is similarly telescopingly received in duct 120. Suitable sealing means such as the resilient gasket 121 provides an effective air seal at the telescoping joint.

As seen in FIG. 3, ducts 118, 120 are joined by a Y-coupling 122 which, in turn, is connected to the inlet of a main evacuation duct 124 having its outlet connected through a second Y-coupling 126 to the dual inlet manifolds 128, 130 of a high volume air filter assembly indicated generally at 132. Air filter 132 may be any suitable filter capable of removing the dust and solids from the mixture of air, smoke and gaseous charging emissions. One commercially available air cleaning assembly found suitable is a dust filter manufactured by the Donaldson Company, Inc. of Minneapolis, Minn. and illustrated in U.S. Pat. No. 4,395,269, the disclosure of which patent is incorporated herein by reference. A Donaldson dust filter of this type is sold commercially under Model No. 4DF 112 and employs a plurality of individual filter elements which may be installed and removed through separate end caps or closures indicated generally at 134 in FIG. 4.

The air filter assembly 132 is mounted by suitable frame structure 136 on one end of the wheeled car 20 for movement with the pushing and charging machine along the oven battery. Filter 132 has an outlet 138 connected to an exhaust blower 140 which, in turn, has its outlet connected to a vertically extending stack 142 open to the atmosphere.

Figure 9:
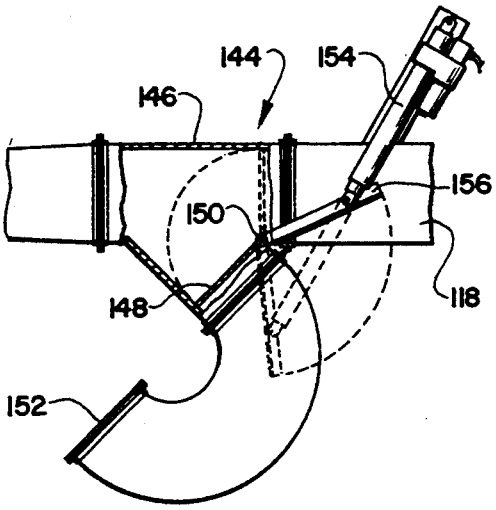
FIG. 9 is a fragmentary sectional view showing a portion of the duct system employed with the apparatus with parts broken away to more clearly illustrate the structure.

Referring now to FIGS. 3 and 9, it is seen that ducts 118, 120 each include a valve assembly 144 mounted in a Y-shaped valve body 146 for controlling the admission of ambient cooling air to the air filter assembly. Since the valves are substantially identical, only one is shown in FIG. 9, and it is to be understood that the description applies to both valves. Thus, valve assembly 144 includes a valve member 148 supported on a shaft 150 for movement between a first position shown in full lines in FIG. 9 and in which the ambient air inlet 152 is closed and the filter 132 is connected directly to the hood 50, and a second position shown in broken lines wherein cooling air is admitted and gas flow from the hood 50 to air cleaner 132 is blocked. Valve member 148 is moved by a selectively operable fluid cylinder 154 connected to an actuating arm 156 mounted on shaft 150 at a location outside the valve body.

In operation of the oven charging and emission capturing apparatus of the present invention, the charging machine is positioned in front of an oven to be charged and the door handler is advanced to engage the oven door. Prior to removing the oven door, the cylinders 64 are actuated to advance the hood toward the ovens and automatically lower the movable wall 66 into contact with the ledge 96 above the open door. The flexible cable support for the movable wall permits the wall to engage the ledge slightly prior to the hood reaching its fully extended position and any further movement of the hood toward the ovens is accommodated by movement of the movable wall 66 within guide channels, thereby assuring an effective seal between the movable wall and the top of the oven. When the hood is advanced, suitable controls such as a limit switch, not shown, are actuated to automatically actuate the fluid cylinder 154 to move the valve assembly 144 to directly connect the interior of the hood with the air cleaner 132. Blower 140 preferably is continuously operated throughout the battery pushing and charging operation so that, when the valve 144 is actuated to close the cooling air inlet, and the oven door is open, any gases or heated air escaping the oven are drawn into the duct system and through the dust filter.

When the door is open, charging conveyor 34 is advanced into the oven and coal fed from hopper 42 is conveyed into the oven chamber. During charging, the conveyor forms an effective bottom wall for the hood and, as the surge of charging emissions is produced upon depositing coal in the hot oven, these emissions are drawn directly through the hood and duct system to be effectively filtered to remove essentially all polluting solids from the emissions before being discharged into the atmosphere.

When the oven is completely charged, conveyor 34 is withdrawn and the door handler 32 is employed to reinstall the door to seal the oven. When the oven is sealed, and the door handler returned to its stored position, fluid cylinders 64 are actuated to withdraw the hood and to lift the movable wall 66 from contact with the top of the oven. Retracting the hood again actuates the vent control valve to open the duct system to the atmosphere so that cooling air from a location spaced from the hot ovens is drawn into the filter assembly to properly cool the filters and any dust collected thereon. At this point, the entire assembly may be advanced to the next oven to be charged and the operation repeated. At suitable intervals, such as upon charging of a complete battery, the exhaust blower 140 is stopped and the solids collection hoppers 158 are emptied through the bottom doors 160.

While a preferred embodiment of the invention has been disclosed and described, it is to be understood that the invention is not so limited and it is therefore intended to include all embodiments which would be apparent to one skilled in the art and which come within the spirit and scope of the invention.

What is claimed is:

1. A method of converting coal to coke in a coking oven including an elongated horizontal coking chamber having its open ends normally closed by removable doors, including the steps of positioning a coal charging machine at one end of the oven, removing the door from the oven and supporting the door at a position spaced outwardly and upwardly from the open end of the oven, providing a movable closed topped emissions capturing hood on the charging machine and positioning the closed top above said door and above said open end of the oven and forming an effective seal between the open end of the oven and the hood, projecting a coal conveyor into the open end of the oven beneath the hood to deposit coal into the oven and to effectively form a bottom wall sealing the hood from the atmosphere, providing an air cleaner supported on the charging machine, providing a closed duct system connecting the interior of the hood with said air cleaner, withdrawing air and emissions from the hood through said duct system and air cleaner to remove solid pollutants therefrom, and discharging the cleaned air and gaseous emissions from the air cleaner to the atmosphere throughout charging of the oven.

2. The method defined in claim 1 further comprising the steps of providing a movable wall on the hood, and moving the wall to a partially retracted position to enable viewing of the oven door from outside the hood.

3. The method defined in claim 2 further comprising the steps of providing a coal hopper on the charging machine for depositing coal onto the conveyor, and utilizing a wall of the coal hopper as an extension of one wall of the hood to effectively seal the hood from the atmosphere during charging of the oven.

4. The method defined in claim 3 further comprising the steps of providing a vertically movable wall on said hood, and moving said vertically movable wall into position contacting and forming a seal with the oven above the open door during charging of the oven.

5. In a coke oven charging machine including a car supported for movement along tracks extending in front of a battery of coke ovens constructed in side-by-side relation with each oven having an elongated coking chamber with open ends normally closed by removable doors, the charging machine having a door handler for removing and supporting an oven door above the open end of an oven during charging of the coking chamber and for replacing the door after charging, and a charging conveyor adapted to be projected into the coking chamber beneath a door supported by the door handler to charge the oven with coal to be coked, the improvement comprising, an emissions charging hood having a closed top and an open bottom, mounting means supporting said hood on said car for movement therewith with said open bottom positioned above said charging conveyor and for movement on said car from a retracted position spaced from an oven to an emissions capturing position adjacent the open end of an oven being charged, end wall means extending from said open bottom to a position adjacent said charging conveyor and cooperating with said closed top to provide communication between an oven and said hood when the oven door is removed, air cleaner means mounted on said car for movement therewith, said air cleaner means having an inlet and an outlet and filter means for removing solids from air and gaseous emissions flowing therethrough, duct means connecting said hood with said air cleaner means inlet, and exhaust blower means operably connected with said air cleaner means for withdrawing air and charging emissions from said hood through said duct means and said filter means and to discharge clean air and gases from the air cleaner means to the atmosphere during charging of an oven.

6. The invention defined in claim 5 wherein said hood comprises movable means for forming a generally gas-tight joint between said open bottom and a respective oven at a location above the open end of an oven during the charging operation.

7. The invention defined in claim 6 wherein said movable means comprises wall means, said wall means being vertically movable with respect to an oven.

8. The invention defined in claim 5 wherein said filter means comprises a plurality of air filters for removing solids from charging emissions and air drawn through the air cleaner means, and hopper means for collecting the solids removed.

9. The invention defined in claim 8 wherein said duct means comprises valve means operable to admit ambient air into said air cleaner means and to restrict the flow of air from said hood after completion of charging of an oven to thereby facilitate cooling of the air cleaner means.

10. The invention defined in claim 5 wherein said open bottom of said hood is effectively closed by said charging conveyor projecting between the end wall means into an oven chamber during charging.

11. The invention defined in claim 10 wherein said end wall means comprises a rigid end wall extending downwardly from said open bottom to a position adjacent said charging conveyor at one side of the conveyor.

12. The invention defined in claim 11 wherein said end wall means further comprises a movable end wall normally extending downwardly from said open bottom to a position adjacent said charging conveyor at the side thereof opposite said rigid wall, said movable wall being retractable to provide substantially unobstructed viewing of the interior of the hood.

13. The invention defined in claim 5 wherein said charging machine includes a fixed coal hopper mounted above said charging conveyor, and wherein said coal hopper includes a fixed wall extending downwardly from said open bottom between said end wall means and cooperating with and effectively forming an extension of said hood.

14. The invention defined in claim 13 wherein said open bottom of said hood is effectively closed by said charging conveyor projecting between said end wall means into a chamber during charging of an oven.

15. The invention defined in claim 14 wherein said hood comprises movable means for forming a generally gas-tight joint between said open bottom and a respective oven at a location above the open end of an oven during the charging operation.

16. The invention defined in claim 15 wherein said movable means comprises movable wall means said wall means being vertically movable with respect to a respective oven.

17. The invention defined in claim 16 wherein said end wall means comprises a rigid end wall extending downwardly from said open bottom to a position adjacent said charging conveyor at one side of the conveyor and a movable end wall normally extending downwardly from said open bottom to a position adjacent said charging conveyor at the other side thereof, said movable wall being retractable to provide substantially unobstructed viewing of the interior of the hood.

* * * * *